US009426593B2

(12) United States Patent
Chiang et al.

(10) Patent No.: US 9,426,593 B2
(45) Date of Patent: Aug. 23, 2016

(54) ASSISTING LISTENING DEVICE HAVING AUDIOMETRY FUNCTION

(71) Applicant: MERRY ELECTRONICS CO., LTD., Taichung (TW)

(72) Inventors: Yung-Yu Chiang, Taichung (TW); Hung-Yue Chang, Taichung (TW); Ming-Fan Wei, Taichung (TW)

(73) Assignee: MERRY ELECTRONICS CO., LTD., Taichung (TW)

( * ) Notice: Subject to any disclaimer, the term of this patent is extended or adjusted under 35 U.S.C. 154(b) by 99 days.

(21) Appl. No.: 14/061,935

(22) Filed: Oct. 24, 2013

(65) Prior Publication Data

US 2014/0050329 A1 Feb. 20, 2014

Related U.S. Application Data

(63) Continuation-in-part of application No. 13/362,403, filed on Jan. 31, 2012, now abandoned.

(51) Int. Cl.
*H04R 29/00* (2006.01)
*H04R 25/00* (2006.01)

(52) U.S. Cl.
CPC ..... *H04R 29/00* (2013.01); *H04R 25/70* (2013.01)

(58) Field of Classification Search
CPC ..... H04R 25/30; H04R 25/305; H04R 29/00; H04R 5/04; H04R 1/1083; H04R 2225/41; H04R 2460/01; H04R 5/033; H04R 2430/01; H04R 25/356; H04R 25/505; H04R 25/45; H04R 29/008; H03G 3/32
USPC ..... 381/60, 56–58, 107, 123, 312, 328
See application file for complete search history.

(56) References Cited

U.S. PATENT DOCUMENTS

| | | | | |
|---|---|---|---|---|
| 2004/0037428 | A1* | 2/2004 | Keller | 381/60 |
| 2007/0076909 | A1* | 4/2007 | Roeck et al. | 381/312 |
| 2009/0245529 | A1* | 10/2009 | Asada et al. | 381/71.6 |
| 2011/0038498 | A1* | 2/2011 | Edgar | 381/314 |

* cited by examiner

*Primary Examiner* — Paul S Kim
*Assistant Examiner* — Norman Yu
(74) *Attorney, Agent, or Firm* — Bacon & Thomas, PLLC

(57) ABSTRACT

An assisting listening device having audiometry function includes an earphone, a testing signal generator, a feedback generator and a control box. The testing signal generator is controlled by a digital signal processor of the control box to provide a testing signal to a speaker of the earphone. The feedback generator will generate a feedback signal to the digital signal processor of the control box subject to the testing signal, enabling the digital signal processor to evaluate the user's hearing threshold level so that the user can adjust the functioning of the assisting listening device optimally subject to the evaluation result.

11 Claims, 4 Drawing Sheets

ASSISTING LISTENING DEVICE HAVING AUDIOMETRY FUNCTION

CROSS-REFERENCE TO RELATED APPLICATION

This patent application is a continuation-in-part of U.S. patent application Ser. No. 13/362,403 filed Jan. 31, 2012 entitled "ASSISTING LISTENING DEVICE HAVING AUDIOMETRY FUNCTION", the entire disclosure of which is incorporated herein by reference.

BACKGROUND OF THE INVENTION

1. Field of the Invention The present invention relates to assisting listening device technology and more particularly, to an assisting listening device having audiometry function.

2. Description of the Related Art

The so-called assisting listening device is to pick up external sound by a microphone, and then to filter noises or adjust the ambient sound by a digital signal processor (DSP), and then to output filtered sound through a speaker toward the user's eardrum. Thus, any person having a different hearing loss level can join community life easily, improving living quality and maintaining good human relations.

However, even persons with hearing loss wearing an assisting listening device, the hearing condition may deteriorate as grow in age. Conventional assisting listening device designs do not provide any audiometry function. If the user cannot adjust the settings of the assisting listening device subject to the user's hearing loss level, the assisting listening device will be unable to process the picked up external sound optimally, affecting the assisting listening effect of the assisting listening device and causing trouble for the user.

Further, after setting of hearing threshold curve subject to a particular hearing-impaired user, the assisting listening device can simply be used by this hearing-impaired user, not suitable for any other person suffering a different condition of hearing loss. Thus, the application of conventional assisting listening device is limited, lacking in popularity.

SUMMARY OF THE INVENTION

The present invention has been accomplished under the circumstances in view. It is the main object of the present invention to provide an assisting listening device having audiometry function, which allows adjustment subject the hearing level of different users or a user's different hearing conditions, providing excellent effects of assisting listening.

To achieve this and other objects of the present invention, an assisting listening device comprises an earphone, a testing signal generator, a feedback generator, and a control box. The earphone comprises a microphone for picking up external sound and generating a corresponding acoustic signal, an acoustic signal processor electrically coupled to the microphone for receiving and processing the acoustic signal, and a speaker electrically coupled to the audio signal processor for receiving the processed acoustic signal and emitting corresponding sound. The testing signal generator is electrically connected to the speaker of the earphone, and adapted to generate a testing signal and transmit the testing signal to speaker. The testing signal generator is disposed outside the earphone. The feedback generator is adapted to generate a feedback signal subject to the testing signal from the testing signal generator. The control box comprises a digital signal processor electrically connected to the acoustic signal processor of the earphone, the test testing signal generator and the feedback generator.

The assisting listening device is switchable between an audiometry mode for evaluating a hearing threshold level of a user, and an assisting listening mode when the speaker emits the sound corresponding to the acoustic signal that is processed subject to the hearing threshold level of the user.

Further, the feedback generator can be a pushbutton electrically connected to the digital signal processor. When hearing the testing signal generated by the testing signal generator, the user can press the pushbutton to provide the feedback signal to the digital signal processor.

Further, the feedback generator can be a microphone electrically connected to the acoustic signal processor of the earphone. When the testing signal from the testing signal generator reaches the user's eardrum, the microphone picks up the sound from the eardrum and converts it into a feedback signal, and then transmits this feedback signal through the acoustic signal processor to the digital signal processor of the control box for reading.

Other advantages and features of the present invention will be fully understood by reference to the following specification in conjunction with the accompanying drawings, in which like reference signs denote like components of structure.

DETAILED DESCRIPTION OF THE INVENTION

Figure 1:
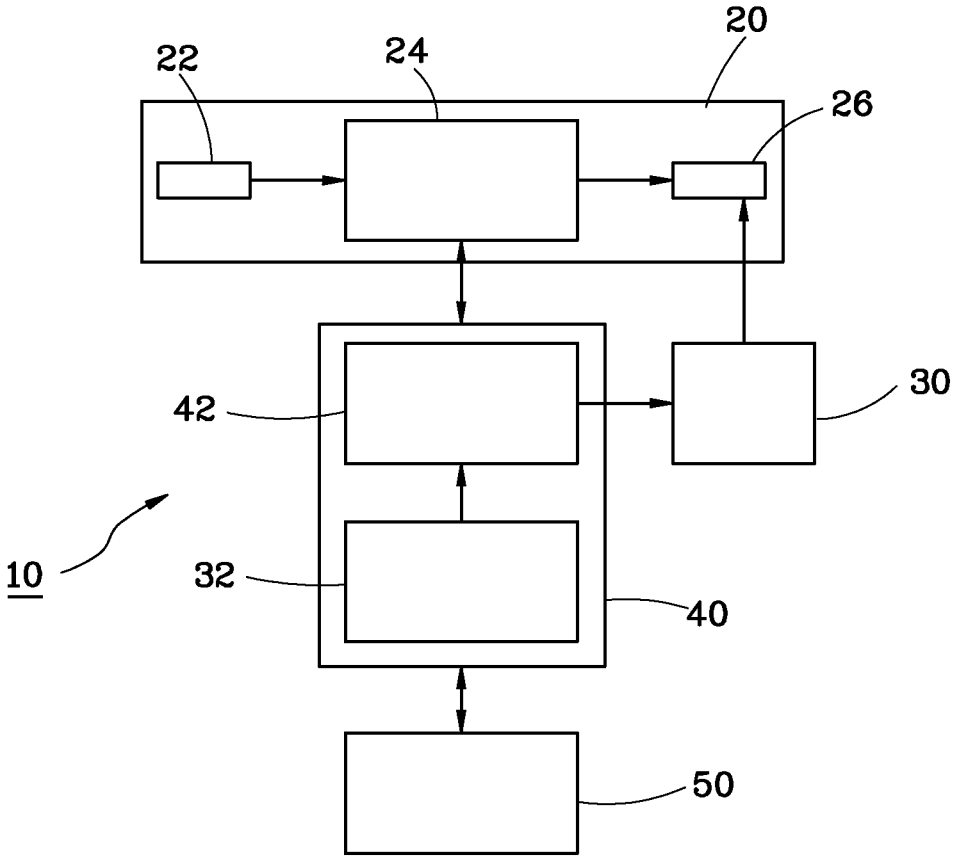
FIG. 1 is a block diagram of an assisting listening device in accordance with a first embodiment of the present invention.

Referring to FIG. 1, an assisting listening device 10 in accordance with a first embodiment of the present invention is shown. The assisting listening device 10 is either manually or automatically switchable between an audiometry mode and an assisting listening mode. The assisting listening device 10 comprises an earphone 20, a testing signal generator 30, a feedback generator 32, and a control box 40. The assisting listening device 10 provides active audiometry function.

The earphone 20 comprises a microphone 22, an acoustic signal processor (ASP) 24 electrically coupled to the microphone 22, and a speaker 26 electrically coupled to the audio signal processor 24. The earphone 20 picks up external sound by the microphone 22 and converts picked up sound into an acoustic signal, which is then processed by the acoustic signal processor 24 and then transmitted by the acoustic signal processor 24 to the speaker 26, causing the speaker 26 to emit corresponding sound toward the user's eardrum. The testing signal generator 30 is electrically connected to the speaker 26 of the earphone 20, and adapted to generate a testing signal and transmit the testing signal to the speaker 26. The testing signal can be a pure tone, warble tone or narrow band noise at 500 Hz, 1000 Hz, 2000 Hz or 4000 Hz.

The feedback generator 32 in this embodiment is a push-button pressable by an external pressure to generate a feedback signal. In other possible embodiments of the present invention, the feedback generator 32 can also be integrated in the earphone 20 or the display device 50.

The control box 40 comprises a digital signal processor (DSP) 42, which is electrically coupled with the acoustic signal processor 24 of the earphone 20, the testing signal generator 30 and the feedback generator 32 for controlling the testing signal generator 30 to generate a testing signal and receiving and storing the feedback signal from the feedback generator 32 for evaluating the user's hearing condition. Further, the digital signal processor (DSP) 42 and the feedback generator 32 can be integrated in the control box 40.

Further, the assisting listening device 10 provides a display device 50 electrically connected to the control box 40, facilitating the user to see the audiometry result and to adjust the function of the control box 40.

Further, the aforesaid display device 50 can be disposed in a mobile phone, computer or TV. Further, electrical connection between the earphone 20/control box 40 and the display device 50 can be done by a cable or in a wireless manner.

Figure 2:
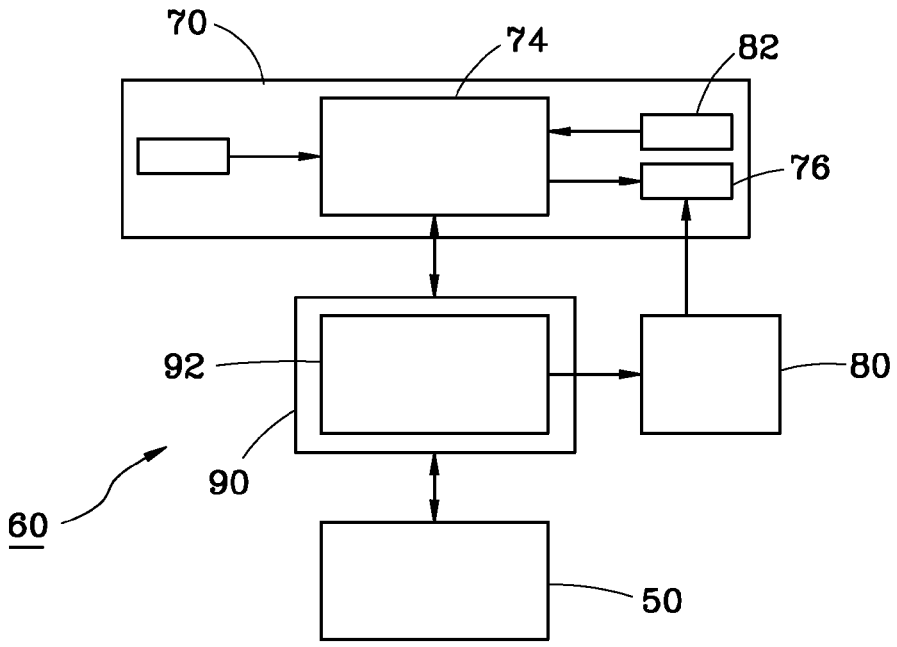
FIG. 2 is a block diagram of an assisting listening device in accordance with a second embodiment of the present invention.

FIG. 2 illustrates an assisting listening device 60 in accordance with a second embodiment of the present invention. This assisting listening device 60 provides a function of passive audiometry, comprising an earphone 70, a testing signal generator 80, and a control box 90. The earphone 70 of this second embodiment is structurally similar to that of the aforesaid first embodiment.

The testing signal generated by the testing signal generator 80 can be narrow band noise, tone burst or distortion product pure tone at 500 Hz, 1000 Hz, 2000 Hz or 4000 Hz.

The feedback generator 82 in this second embodiment is a microphone or a sensor integrated in the earphone 70 and electrically connected to the acoustic signal processor 74 of the earphone 70.

When the assisting listening device 60 is switched to the audiometry mode by using the control box 90, the testing signal generator 80 will be controlled by the digital signal processor 92 to generate a testing signal. When the testing signal is transmitted from the testing signal generator 80 through the speaker 76 to the user's eardrum, the feedback generator 82, which is a microphone in this second embodiment, will automatically pick up the sound from the vibration of the eardrum and convert it into a feedback signal, and then transmit this feedback signal through the acoustic signal processor 74 to the digital signal processor 92 of the control box 90 for determining the hearing threshold level.

Similarly, the digital signal processor 92 of the control box 90 can be electrically connected to a display device 50 to provide the same effects as the aforesaid first embodiment.

Further, the feedback generator 82 can also be used for background noise correction. When the user is in a noisy environment, the assisting listening device can use the feedback generator 82 to pick up sound from the ear canal and then remove the unnecessary noises for determining the user's hearing level accurately.

Figure 3:
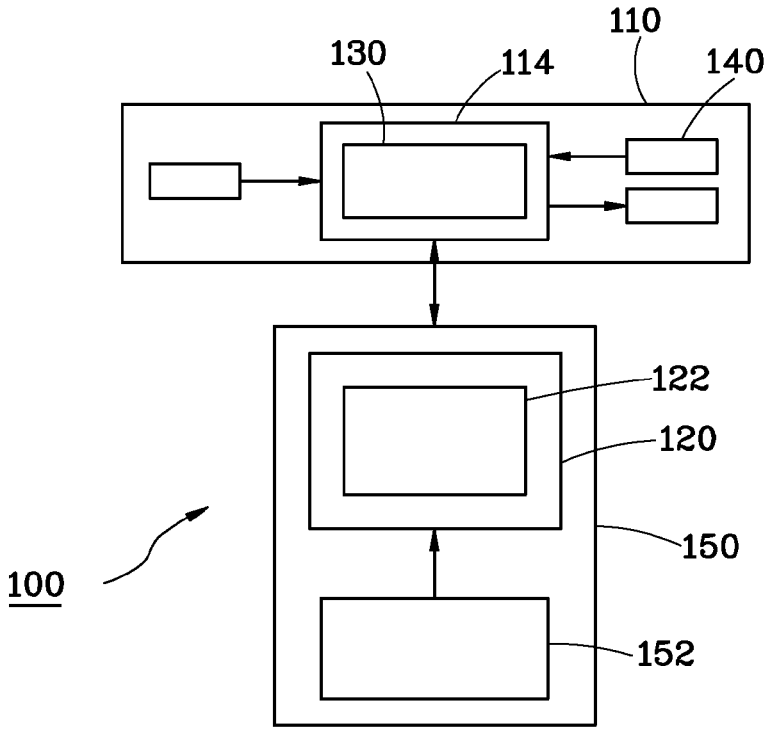
FIG. 3 is a block diagram of an assisting listening device in accordance with a third embodiment of the present invention.

FIG. 3 illustrates an assisting listening device 100 in accordance with a third embodiment of the present invention. The assisting listening device 100, likewise, includes an earphone 110, a control box 120, a test signal generator 130 integrated in the acoustic signal processor 114 of the earphone 110, a feedback signal generator 140 integrated in the earphone 110, and a display device 150 such as a mobile phone. The earphone 110 in this third embodiment is structurally identical to that in the second embodiment. On the other hand, the control box 120 includes a digital signal processor 122 and is functionally integrated in the display device 150, which is further integrated with a user interface 152 for switching the assisting listening device 100 between the audiometry mode and the assisting listening mode. The user interface 152 can be realized in the form of, for example, a touch panel that functions as a switch in the present embodiment. In other possible embodiments of the present invention, however, a switch can also be alternatively provided on the earphone, the control box or the display device for the user to manually switch the modes of the assisting listening device. In some other possible embodiments that the switching of modes is automatically done by the control box, a physical switch is not necessarily provided on the assisting listening device.

Figure 4:
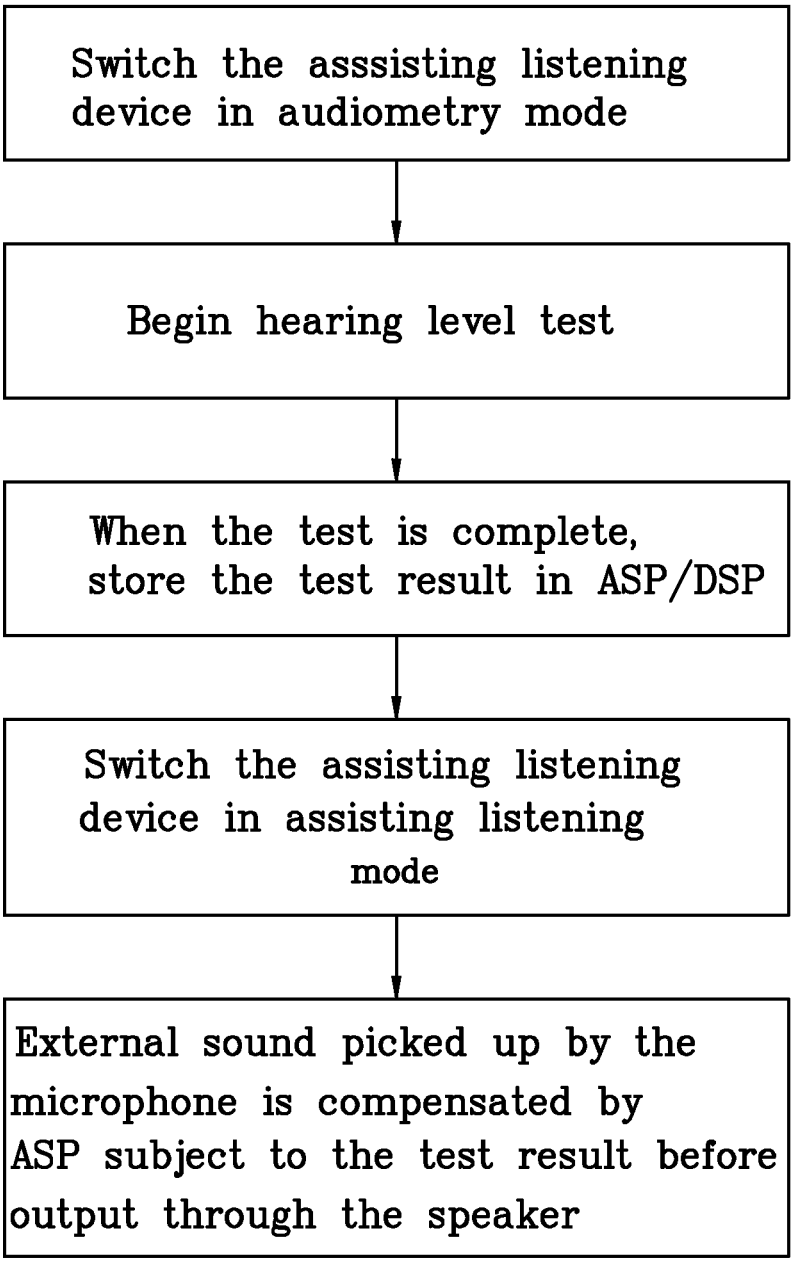
FIG. 4 is a preferable overall working flowchart of an assisting listening device of the present invention.

Referring to FIGS. 1 and 4. When the assisting listening device 10 is switched to the audiometry mode, the digital signal processor 42 transmits a control signal to the testing signal generator 30. At this time, the testing signal generated by the testing signal generator 30 will be transmitted through the speaker 26 of the earphone 20 toward the user's eardrum. A feedback signal can be either manually generated or automatically generated by the feedback generator 32 and transmitted to the digital signal processor 42 of the control box 40, enabling the digital signal processor 42 to determine the user's hearing level subject to the feedback signal. A preferable determination of the user's hearing level is to pick up the most suitable one from the various hearing threshold curves defined subject to the user's hearing condition, and then a test result determined by the digital signal processor 42 is stored in the acoustic signal processor 24 as the third step in FIG. 4. Alternatively, the test result determined by the digital signal processor 42 can be stored right in the digital signal processor 42 itself in other possible embodiments of the present invention.

Figure 5:
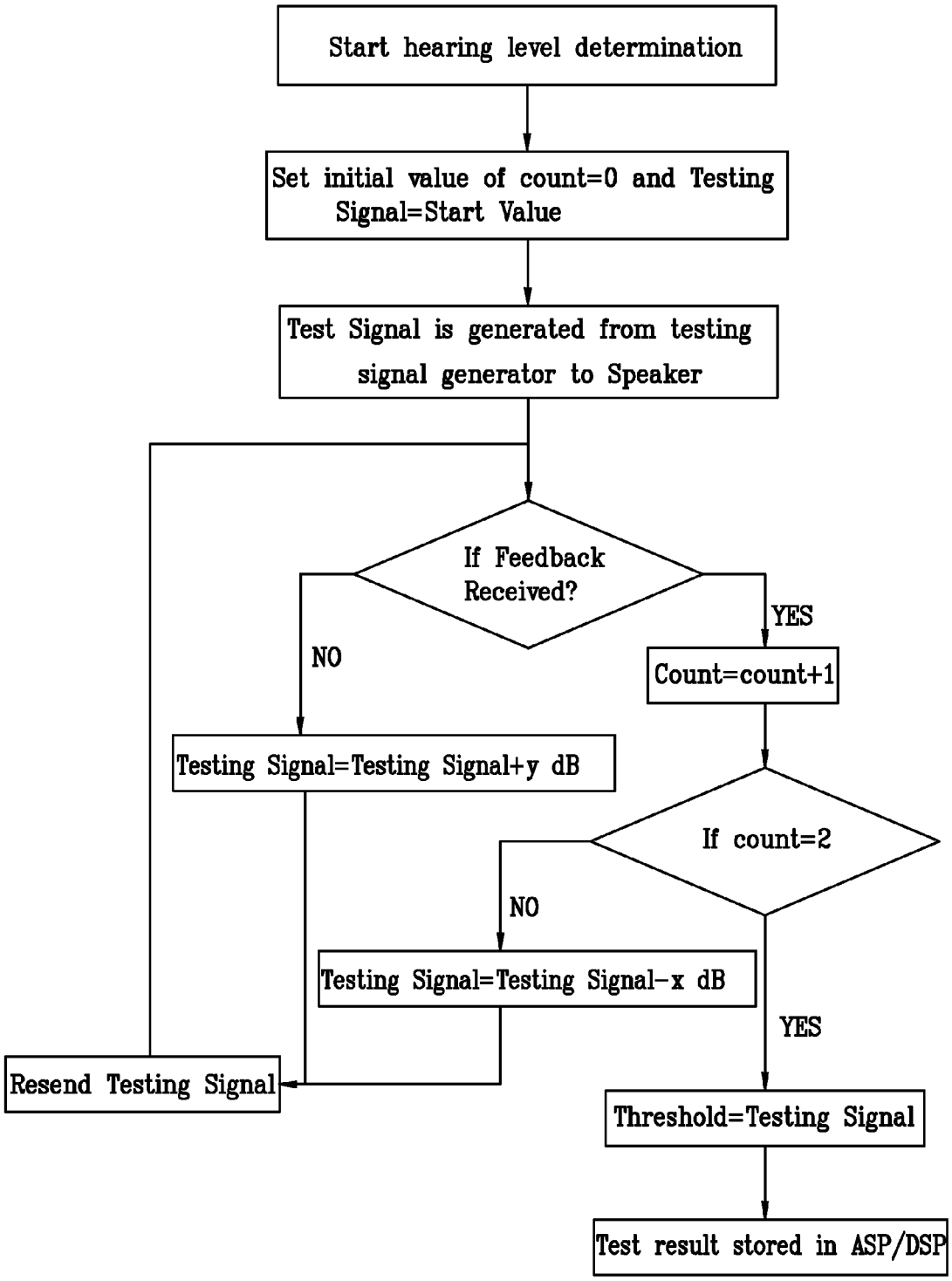
FIG. 5 is a preferable working flowchart of an assisting listening device of the present invention, in which the assisting listening device is in the audiometry mode.

More specifically, a flowchart of a preferable determination of the user's hearing level is shown in FIG. 5. When the determination starts, the digital signal processor 42 will set an initial value of Count to 0 and a dB value of the testing signal to a start value, e.g. 0. Then the digital signal processor 42 will send the testing signal at that specific dB value to the speaker 26 via the testing signal generator 30. If the digital signal processor 42 receives a feedback signal manually or automatically generated by the feedback generator 32, the digital signal processor 42 will add 1 to Count and determine if Count is already 2. If not, the digital signal processor 42 will reduce the dB value of the testing signal by x dB where x is preferably between 1-20 and more preferably 10 in a preferred embodiment. The digital signal processor 42 then resends the testing signal with reduced dB value and test again. On the other hand, if the digital signal processor 42 does not receive the response signal, which implies that the user is unable to hear the testing signal at that specific dB value, the digital signal processor 42 will increase the dB value of the testing signal by y where y is preferably between 1-20 and more preferably smaller than x, e.g. y is 5 in the preferred embodiment, and then resend the testing signal. Repeat the test until the number of Count is 2. When the test is completed, a threshold of the user's hearing level is set to be the final dB value of the testing signal and the test result is stored in the acoustic signal processor 24 or the digital signal processor 42.

Referring to the fourth and the fifth steps in FIG. 4. When the assisting listening device 10 is switched, either manually or automatically after the afore-mentioned test is finished, to the assisting listening mode, the microphone 22 of the earphone 20 picks up external sound and converts it into an acoustic signal processor 24, and then the acoustic signal processor 24 filters noises from the acoustic signal and then adjusts the acoustic signal subject to the test result. For example, if the threshold value determined in the audiometry mode is 3 dB higher than a predetermined value, the acoustic signal generates by the microphone 22 is compensated with 3 dB by the acoustic signal processor 24. The compensated acoustic signal is then transmitted to the speaker 26, causing the speaker 26 to emit corresponding sound at the compensated dB value toward the user's eardrum, and thus, the user can hear the sound smoothly. In some possible embodiments that the test result is stored in the digital signal processor 42 rather than in the acoustic signal processor 24, the acoustic signal processor 24 will further read the test result from the digital signal processor 42 before compensating the acoustic signal transmitted from the microphone 22.

In conclusion, the assisting listening device of the present invention provides an audiometry function for enabling the user to know his (her) hearing level. Further, the audiometry mode has two different designs. A user can adjust the functioning of the assisting listening device subject to the audiometry result. Or, the digital signal processor of the assisting listening device can automatically adjust the best operating mode subject to the audiometry result to fit different users suffering different degrees of hearing loss, enabling every user to hear sound comfortably and achieving excellent effects of assisting listening.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An assisting listening device, comprising:

an earphone comprising a microphone for picking up external sound and generating a corresponding acoustic signal, an acoustic signal processor electrically coupled to said microphone for receiving and processing the acoustic signal, and a speaker electrically coupled to said audio signal processor for receiving the processed acoustic signal and emitting corresponding sound;

a testing signal generator electrically coupled to said speaker of said earphone and adapted for providing a testing signal to said speaker, the testing signal generator being integrated in the earphone;

a feedback generator integrated into the earphone and adapted for generating a feedback signal subject to the testing signal generated by said testing signal generator; and a control box comprising a digital signal processor electrically connected to said acoustic signal processor of said earphone, said testing signal generator and said feedback generator;

wherein the assisting listening device is switchable between an audiometry mode stored in the earphone for evaluating a hearing threshold level of a user, and an assisting listening mode when the speaker emits the sound corresponding to the acoustic signal that is processed subject to the hearing threshold level of the user, wherein when the assisting listening device is in the audiometry mode, the feedback signal is used to pick up one of a plurality of hearing threshold curves defined subject to a hearing condition of the user, the picked up hearing threshold curve being stored in the digital signal processor, and wherein when the assisting listening device is in the listening mode, the acoustic signal processor reads the stored hearing threshold curve and adjusts the acoustic signal to compensate for the hearing threshold of the user.

2. The assisting listening device as claimed in claim 1, wherein when the assisting listening device is in the audiometry mode, the digital signal processor controls the testing signal generator to generate the testing signal and receives the feedback signal generated by the feedback generator for evaluating the hearing threshold level, the digital signal processor then stores a test result for the hearing threshold level to the acoustic signal processor;

wherein when the assisting listening device is in the assisting listening mode, the microphone picks up the external sound and sends the corresponding acoustic signal to the acoustic signal processor, the acoustic signal processor processes the acoustic signal subject to the test result and then sends the processed acoustic signal to the speaker.

3. The assisting listening device as claimed in claim 1, wherein said feedback generator is a microphone integrated in said earphone and electrically connected to said acoustic signal processor for converting sound emitted by the eardrum subject to said testing signal into said feedback signal and transmitting said feedback signal through said acoustic signal processor to said digital signal processor of said control box.

4. The assisting listening device as claimed in claim 1, further comprising a display device electrically connected to said control box and adapted for displaying the evaluated hearing threshold level.

5. The assisting listening device as claimed in claim 4, wherein the control box is integrated in the display device.

6. An assisting listening device for use with a portable device, said assisting listening device, comprising:

an earphone comprising a microphone for picking up external sound and generating a corresponding acoustic signal, an acoustic signal processor electrically coupled to said microphone for receiving and processing the acoustic signal, and a speaker electrically coupled to said audio signal processor for receiving the processed acoustic signal and emitting corresponding sound;

a testing signal generator electrically coupled to said speaker of said earphone and adapted for providing a testing signal to said speaker;

a feedback generator integrated with the portable device and adapted for generating a feedback signal subject to the testing signal generated by said testing signal generator;

a control box comprising a digital signal processor electrically connected to said acoustic signal processor of said earphone, said testing signal generator and said feedback generator; and a display device disposed in the portable device and being integrated with a user interface for switching the assisting listening device between an audiometry mode stored in the earphone for evaluating a hearing threshold level of a user, and an assisting listening mode when the speaker emits the sound corresponding to the acoustic signal that is processed subject to the hearing threshold level of the user, wherein when the assisting listening device is in the audiometry mode, the feedback signal is used to pick up one of a plurality of hearing threshold curves defined subject to a hearing condition of the user, the picked up hearing threshold curve being stored in the digital signal processor, and wherein when the assisting listening device is in the listening mode, the acoustic signal processor reads the stored hearing threshold curve and adjusts the acoustic signal to compensate for the hearing threshold of the user.

7. The assisting listening device as claimed in claim 6, wherein when the assisting listening device is in the audiometry mode, the digital signal processor controls the testing signal generator to generate the testing signal and receives the feedback signal generated by the feedback generator for evaluating the hearing threshold level, the digital signal processor then stores a test result for the hearing threshold level to the acoustic signal processor;

wherein when the assisting listening device is in the assisting listening mode, the microphone picks up the external sound and sends the corresponding acoustic signal to the acoustic signal processor, the acoustic signal processor processes the acoustic signal subject to the test result and then sends the processed acoustic signal to the speaker.

8. The assisting listening device as claimed in claim 6, wherein said feedback generator is a pushbutton integrated in said control box and electrically connected to said digital signal processor and operable by an external pressure to provide said feedback signal to said digital signal processor of said control box subject to said testing signal.

9. The assisting listening device as claimed in claim 6, wherein the testing signal generator is disposed outside the earphone.

10. The assisting listening device as claimed in claim 6, wherein the control box is integrated in the display device.

11. An assisting listening device, comprising:

an earphone comprising a first microphone for picking up external sound and generating a corresponding acoustic signal, an acoustic signal processor electrically coupled to said microphone for receiving and processing the acoustic signal, and a speaker electrically coupled to said audio signal processor for receiving the processed acoustic signal and emitting corresponding sound;

a testing signal generator electrically coupled to said speaker of said earphone and adapted for providing a testing signal to said speaker, the testing signal generator being integrated in the earphone;

a feedback generator integrated into the earphone and adapted for generating a feedback signal subject to the testing signal generated by said testing signal generator; and a control box comprising a digital signal processor electrically connected to said acoustic signal processor of said earphone, said testing signal generator and said feedback generator;

wherein the assisting listening device is switchable between an audiometry mode that is stored in earphone for evaluating a hearing threshold level of a user, and an assisting listening mode when the speaker emits the sound corresponding to the acoustic signal that is processed subject to the hearing threshold level of the user, and wherein said feedback generator is a second microphone adapted for picking up a sound from a vibration of an eardrum of the user;

wherein when the assisting listening device is in the audiometry mode, the digital signal processor controls the testing signal generator to generate the testing signal and receives the feedback signal generated by the feedback generator for evaluating the hearing threshold level, the digital signal processor then stores a test result for the hearing threshold level to the acoustic signal processor; and wherein when the assisting listening device is in the assisting listening mode, the first microphone picks up the external sound and sends the corresponding acoustic signal to the acoustic signal processor, the acoustic signal processor processes the acoustic signal subject to the test result and then sends the processed acoustic signal to the speaker.

* * * * *